United States Patent [19]

Schwörer et al.

[11] Patent Number: 4,886,234

[45] Date of Patent: Dec. 12, 1989

[54] SHUTTERING APPARATUS

[75] Inventors: Artur Schwörer, Wullenstetten; Hans Braun, Memmingen, both of Fed. Rep. of Germany

[73] Assignee: Peri-Werk Artur Schworer GmbH & Co. KG, Weissenhorn, Fed. Rep. of Germany

[21] Appl. No.: 274,585

[22] Filed: Nov. 22, 1988

[30] Foreign Application Priority Data

Nov. 23, 1987 [DE] Fed. Rep. of Germany ..... 3739633

[51] Int. Cl.[4] ..... E04C 1/10

[52] U.S. Cl. ..... 249/196; 52/582; 52/584; 249/47; 249/192; 249/219.1

[58] Field of Search ..... 249/192, 195, 196, 219.1, 249/219.2, 47; 52/582, 584, 585, 127.9

[56] References Cited

U.S. PATENT DOCUMENTS

| | | | |
|---|---|---|---|
| 953,383 | 3/1910 | Holman | 249/219.2 |
| 1,636,256 | 7/1927 | Strom | 249/47 |
| 2,693,628 | 11/1954 | Hammel | 249/47 |
| 2,964,294 | 12/1960 | Imanetti | 249/219.2 |
| 3,712,013 | 1/1973 | Kalus | 52/127.9 |

*Primary Examiner*—Jay H. Wood
*Assistant Examiner*—K. P. Nguyen
*Attorney, Agent, or Firm*—Townsend and Townsend

[57] ABSTRACT

A connecting element is provided for connecting together adjacent shuttering panels of the kind in which reinforcement strips with rows of holes provided therein are arranged at the edges of the shuttering panels and are dipsosed perpendicular thereto. The connecting element consists essentially of a curved lever arm (13) which tapers from a spigot part (17) to an end surface (18). The spigot part (17) adjoins a handle portion of the connecting element at a flange (16') defining an abutment edge (16). The handle portion is curved in essentially U-shaped manner and has a support surface (20) at the inside of its limb connected to the spigot portion (17). In operation the engagement end (18) of the lever arm is first introduced through two aligned holes in the adjacent reinforcement strips of two adjacent shuttering panels and the connecting element is then rotated about the abutment edge (16) so as to cause the spigot part (17) to enter into the two aligned bores. During this the lever arm clamps the two reinforcement strips together. In the engaged position shown in FIG. 2 the support surface (20) contacts one side of one of the connecting strips and the engagement surface (18) contacts the opposite side of the other reinforcement strip. The U-shaped handle of the connecting element has been pivoted downwardly so that the abutment end (12') thereof engages against the same side of the reinforcement strip (15') as the engagement surface (18). In this position the connecting element is reliably locked in place and the shuttering panels are reliably connected together.

19 Claims, 2 Drawing Sheets

SHUTTERING APPARATUS

BACKGROUND OF THE INVENTION

The invention relates to a shuttering apparatus with at least two shuttering panels which respectively comprise a shuttering skin and reinforcement strips which are disposed at least some of the edges of the shuttering panels, which project substantially perpendicular to their rear sides and which have a plurality of connection bores; and at least one connection member for two adjacent shuttering panels, with the connection member having a spigot part which can be passed through two mutually aligned bores of two directly contacting reinforcement strips and a hook part which branches off from the one end of the spigot part, and which can be brought, when the spigot part is inserted, by pivoting of the hook part into engagement with that reinforcement strip which faces away from the connection plane between the spigot and the hook part.

It is already known to arrange the shuttering panels of such shuttering apparatus directly alongside or above one another in alignment in such a way that the holding bores of the reinforcement strips which directly contact one another at the edges of the shuttering panels are aligned with one another. Bolts can then for example be pushed through the mutually aligned holding bores and can be secured by means of wedges, with the reinforcement strips and thus the shuttering skins which are held by them being drawn together by the wedge action. An endeavour is made to keep the gap between adjacent shuttering panels as small as possible.

Furthermore, one-piece joint clamps are also provided for the connection of adjacent shuttering panels, with the joint clamps having a spigot part which can be pushed through the aligned holding bores and a hook part which is connected with the spigot part. After the spigot part has been pushed largely free of play through the holding bores the hook part is pivoted downwardly and clampingly over the two closely adjacent connecting strips of the adjacent shuttering panels, whereby the connection strips are drawn together and the desired connection between the two shuttering panels is effected.

The advantage of this known joint clamp lies in the fact that one can operate with a single connection element. However, on pivoting the clamp downwardly and on clamping of the hook part onto the reinforcement strips a force which draws the shuttering panels together is essentially only exerted at points which are further removed from the shuttering skin. The shuttering panels are thus not ideally drawn together precisely at the side where the concrete is pored. Accordingly, ugly impressions and bleeding out of the concrete can arise at the connection positions between the shuttering panels.

SUMMARY OF THE INVENTION

The principal object underlying the present invention is thus to provide a shuttering apparatus or formwork of the initially named kind with which a reliable drawing together of adjacent shuttering panels is ensured despite the use of a one-piece connection member, with the forces which draw the panels together being exerted both as close as possible to the shuttering skin and also at the rear end of the reinforcement strips.

In order to satisfy this object the present invention provides an arrangement of the initially named kind which is characterized in that the spigot part only has a length substantially the same as the thickness of the two reinforcement strips through which it passes, is restrictedly pivotable about an axis perpendicular to the plane formed by its central longitudinal axis and that of the hook part, and also passes at the end remote from the connection plane with the hook part into a curved and/or kinked lever arm which is remote from the hook part and of smaller cross-section than the bores, with the lever arm being insertable through the two substantially aligned bores from one side of one of the reinforcement strips until the spigot part is located inside the bores and the outer end surface of the lever arm remote from the hook part contacts the other reinforcement strip; in that the hook part has a support surface at the side of the spigot remote from the lever arm and facing the connection strip provided at the side of the connection plane, with the support surface coming into contact in the installed state with the reinforcement strip disposed at the connection plane side when the spigot part is inserted into the bores; and in that, when the engagement end of the hook part is in engagement with the associated reinforcement strip, the support surface is clamped against the contacting reinforcement strip on the side opposite to the engagement end, and the end surface of the lever arm is clamped against the contacting reinforcement strips from the same side as the engagement end.

In this manner the two reinforcement strips of the adjacent shuttering panels are clamped firmly together by contact of the support surface of the hook part on the one side of the contacting reinforcement strips and by the contact of the end surface of the lever arm and of the engagement end of the hook part on the other side of the contact strips and indeed over a relatively long path which extends from a location close to the shuttering skin to the rear edge of the reinforcement strips. At the same time the spigot part which passes through the bores ensures the desired form locked connection of the two shuttering panels.

In order to also obtain a force on insertion of the connecting element into the aligned bores of two at least approximately contacting connection strips which draws the two connecting strips together a particularly preferred embodiment of the invention provides that that the connection element has an abutment edge, preferably a rounded abutment edge, at the side of the spigot part remote from the hook part and substantially in alignment with the connection plane between the hook part and the spigot part, with the abutment edge contacting the reinforcement strip facing the insertion side during introduction of the spigot part into the aligned bores; that the lever arm has a cross-section which reduces in the direction away from the spigot part and can be passed through the two substantially mutually aligned bores of the at least closely adjacent reinforcement strips until the abutment edge contacts the reinforcement strip remote from the lever arm whereupon, by the action of force on the hook part which has not yet engaged with the reinforcement strip, in the sense of generating a torque about the contact point of the abutment edge on the reinforcement strip, the correspondingly constructed concave inner surface of the lever arm is guided along the edge facing the shuttering skin of the bore remote from the introduction side or, if the reinforcement strips have not yet fully contacted one another, is pressed against the edge and is pushed slidingly over the edge to draw together the reinforcement strips which are not yet fully in contact, until the spigot part is located inside the bores and the outer end surface of the lever arm remote from the hook part comes into contact with the reinforcement strip remote from the connection plane, and also until the support surface comes into contact with the associated connection strip, whereupon the engagement end of the hook part is pivoted into engagement with the associated connection strip.

The essential concept underlying this embodiment is to be seen in the fact that the connection member first acts as a lever with a very large lever arm ratio (mechanical advantage) between the lever arm which is actuated by hand and the lever arm which is pushed through the holding bores, whereby with comparatively small hand forces quite considerable forces can be exerted to draw together the confronting, slightly spaced reinforcement strips of adjacent shuttering panels. Since the connecting element is in this stadium expediently kept perpendicular to the plane of the shutter skin these drawing together forces are exerted at the edge of the bores adjacent the shuttering skin, i.e. relatively close to the shuttering skin. As soon as the two adjacent shuttering panels have been drawn together as closely as possible in this manner the hook part is pivoted about the axis of the spigot part until the engagement end of the hook part contacts, and comes into form locked engagement with, the reinforcement strip lying on the side of the first lever arm. Since the engagement end of the hook part comes into engagement with the reinforcement strip relatively close to the rear end thereof forces which draw the reinforcing strips together are also exerted in this manner at this location.

Thus, forces which pull the connecting strips of the adjacent shuttering panels together are exerted along the oblique axis of the connection element both close to the shuttering skin and also close to the rear edge of the connection strips. The support surface of the hook part lies on the opposite side of the connection strips from the other two surfaces which exert forces on the one side of the contacting reinforcement strips, namely the end surface of the lever arm and the engagement end of the hook part, between these two other surfaces in a clamping manner. In this way the clamping forces are exerted on the reinforcement strips over a relatively long path between a region close to the shuttering skin and the rear end of the reinforcement strips, and thus in relatively uniform manner.

Thus the connection element of the invention makes it possible to provide large forces for drawing the panels together during installation, but also makes it possible for the forces which hold the reinforcement strips and thus the shuttering panels together after installation to be distributed over the largest possible depth of the reinforcement strips, so that the clamping forces are not only exerted in the region of the bores or indeed only behind the bores as in the known arrangements.

A further advantage of the invention is the relatively large spacing between the tension and pressure points which ensures a connection which is relatively stiff in bending.

Since the shuttering panels are drawn together relatively close to the side of the shuttering panels adjacent the concrete bleeding out of the concrete is also effectively prevented.

Furthermore it is advantageous that the connecting elements of the invention can also be removed under tension (under pressure of concrete) because they are removed by pivoting them outwardly and do not have to be drawn outwardly.

A further advantageous embodiment of the invention is characterized in that the concave inner surface of the lever arm is curved in a direction perpendicular to the central axes so that it has a contact line or surface with the edge of the hole which is as large as possible on contact with the edge of the hole. In this way a relatively large area contact of the lever arm is obtained at the relevant edge of the bore of the reinforcement strip so that the surface forces generated on insertion of the connecting element and on drawing together of the connection strips are restricted.

By means of this embodiment one ensures that the lever arm can first of all be introduced effortlessly without the expenditure of force into the two aligned bores of two reinforcement strips until the free end of the lever arm emerges at the opposite side of the bores. If the hook part is now pivoted in its plane in such a way that the lever arm engages around the end of the bore then the concave inner surface of the lever arm comes into contact with the exit edge of the rear bore and this engagement increases continuously with increasing pivoting of the hook part and entry of the spigot part into the bores which results in the drawing together of the two reinforcement strips (connection strips) in a particularly uniform manner. In other words the forces which pull the reinforcement strips and thus the shuttering panels together increase continually until the reinforcement strips contact one another in the desired manner. Automatic securing of the connection elements against dropping out unintentionally is ensured by the fact that the abutment edge and the end surface of the lever arm are displaced relative to one another in the plane of the central axes. This is done in such a way that a moment which biases the connection member into its engaged position is achieved by the forces which are trying to separate the two reinforcement strips which are to be connected. This moment is achieved when the connection member is already located in an engagement position which holds the connection strips together and which is no longer far moved from its position in the finally installed state. In this way it is ensured that even if the engagement end of the hook part has not yet engaged with the reinforcement strips, or is no longer in engagement with reinforcement strips, the connecting element will not be pressed out of the position where the spigot part is located within the bores by any forces which try to push the reinforcement strips apart.

Thus, through the aforementioned displacement of the forces from the connection strips, a moment is generated in accordance with the invention by the forces which are exerted on the connection element from the pressed apart connection strips which automatically biases the connection element into the direction in which it retains its position in which the spigot part is essentially located within the bores.

It is particularly advantageous for the hook part to have, in the installed state, a substantial spacing from the next closest reinforcement strip at the side of the reinforcement strips remote from its engagement end. In this manner the hook part can be resiliently pivoted during installation somewhat further than its end position in the clamping direction whereupon the tilting into the engaged position with the reinforcement strips is facilitated.

A further advantageous embodiment is characterized in that the lever arm has essentially the shape of an arc which extends over an angle of 180°. It is furthermore advantageous for the lever arm to taper continuously starting from the spigot part.

In order to obtain, on the one hand, a continuous transition from the spigot part into the lever arm and, on the other hand, in order to obtain a contact surface at the end of the lever arm which is as broad as possible, an advantageous further development of the invention provides that the lever arm merges from a substantially round cross-section at the spigot part to an elliptical cross-section in the region of the outer end surface, with the longer axis of the ellipse preferably extending perpendicular to the plane of the central axes, and with the end surface being expediently flattened in order to form a larger contact surface.

Furthermore, it is expedient for the abutment edge to be part of a flange which extends around the spigot part. In the installed state no force should normally be exerted on the connection strips since this function is reserved for the support surface on the hook part. Fundamentally, at least a part of the support force could however also be transferred via the relevant flange to the reinforcement strips at the side remote from the lever arm and the engagement end. In accordance with an alternative embodiment the region of the flange facing the hook part could also serve as a support surface for the hook part at the reinforcement strip.

A uniform distribution of the forces which fall on the panels together can be promoted when the additional support surface is disposed essentially half way between the end surface of the lever arm and the engagement end of the hook part.

In order to ensure a drawing together of two adjacent shuttering panels with relatively small forces it is furthermore expedient for the counterlever arm formed by the hook part to be approximately 5 to 15 and in particular approximately 10 times as long as the distance which is present between the end surface of the lever arm and the abutment edge.

In order to ensure centering of the connection element in all directions both during installation and in the installed state, and also to ensure the required degrees of freedom of movement, it is furthermore advantageous for the spigot part to have the shape of the surface of a portion of a ball or sphere with a diameter approximately the same as the diameter of the connecting bores.

In order to obtain an ideal distribution of the forces both in the depth direction and also in the longitudinal direction of the reinforcement strips it is furthermore expedient when, in the installed state, the angle between the longitudinal axis of the reinforcement strip and the plane of the central axes of the connection element amounts to between 15° to 45°, in particular to 20° to 40°, preferably to 25° to 35° and in general to approximately 30°.

A further embodiment is characterised in that the support surface projects—in the installed state—somewhat further in the direction of the reinforcement strips than the abutment edge.

In this manner it is ensured that a lever arm is first formed between the abutment edge and the region of the lever arm which contacts the associated reinforcement strip during the process of drawing together the two adjacent reinforcement strips, whereby the lever ratio is first very coarse and large forces are exerted. In the last stadium of the pivotal movement of the hook part the support surface comes into engagement with the surface at the associated reinforcement strip whereby the support point is displaced substantially further away from the lever arm in the direction of the hook part. This is a sign for the operator that the degree of drawing together of the two shuttering panels which is required has now been achieved and that the hook part can be swung in the direction of the reinforcement strips around the axis of the spigot part until the engagement end of the hook part has been displaced behind the reinforcement strips and come into engagement with the latter.

The larger spacing of the support surface from the end surface of the lever arm relative to the spacing of the abutment edge to the end surface of the lever arm has furthermore the advantage that in this way larger tolerances of the connection strips or of their arrangement relative to one another can be better compensated.

When the support surface is pressed onto the reinforcement strips the flange with the abutment edge is then largely relieved and can indeed lift somewhat from the reinforcement strips.

A further advantageous embodiment is characterised in that the engagement end of the hook part includes, in the installed state, when viewed towards the rear side of the reinforcement strips a small angle $\beta$ of preferably 3 to 10 and in particular 4° to 80. In this manner the thickness tolerances in the region of the reinforcement strips which contact one another can be particularly well compensated for. On pivoting the hook part downwardly the contact surface of the engagement end slides onto the one edge of the reinforcement strip and thereby clamps the hook part and the lever arm against the reinforcement strips.

This automatic clamping and thickness compensating effect can be further promoted in that the engagement end has substantially greater width in a section substantially perpendicular to its longitudinal axis than the oppositely disposed regions of the hook part, and in that the surface which in the installed state faces the associated reinforcement strip is obliquely shaped in such a way that the engagement end contacts the associated reinforcement strip in the installed state linearly or along a narrow straight strip region. In this arrangement it is particularly advantageous when the surface of the engagement end which enters into engagement with the reinforcement strip is of substantially flat shape and represents a section through a trapezoidal thread-like screw surface, the central axis of which coincides with the central axis of the spigot part.

In this manner the engagement end of the hook part lies, on pivoting the hook part towards the reinforcement strips, linearly or in strip-like manner on the rear edge of the reinforcement strips. The angles are in any event kept so small in this case that self-locking arises in conjunction with the friction forces which are present.

It is particularly advantageous when the engagement end has inclined surfaces which are constructed in mirror-like manner relative to one another on both sides of its central longitudinal plane is such a way that a linear or strip-like clamping can be effected between the engagement end and the reinforcement strip irrespective of the side from which the lever arm is introduced into the aligned bores. Here the engagement end of the hook part is symmetrically constructed in the sense that the connection element can be inserted from both sides into the aligned connection bores. The connection element of the invention can accordingly be inserted without problem by right or left handed persons from the one or other side into the aligned bores and can then be pivoted downwardly or upwardly.

The invention will now be described by way of example only and with reference to the accompanying drawings in Which are shown:

DETAILED DESCRIPTION OF THE PREFERRED EMBODIMENT

Figure 1:
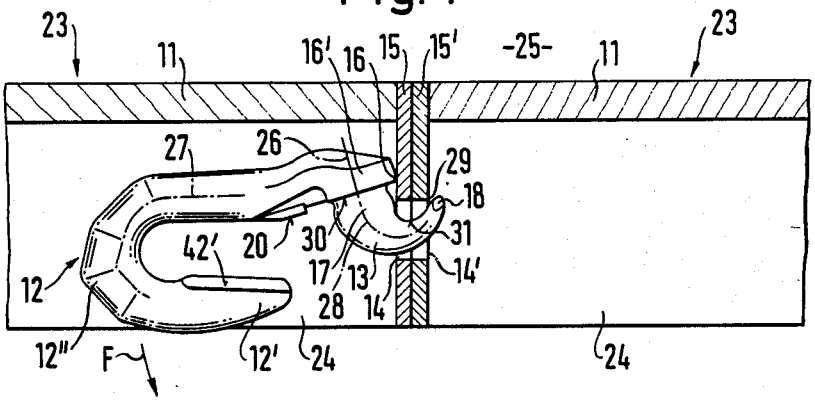
FIG. 1 a schematic partly sectioned plan view of two adjoining circuit panels with a connection member of a shuttering apparatus in accordance with the invention being shown in its initial position, FIG. 2 a rear view of the subject of FIG. 1, however with the connection member having been transferred into the finally installed state, FIG. 3 a schematic sideview of the subject of FIG. 2, FIG. 4 a section on the line IV-IV in FIG. 2 and FIG. 5 a similar view to that of FIG. 1 however with the two reinforcement strips 15, 15' being shown at a small spacing and with the connection member consisting of the hook part 12, the spigot part 17 and the lever arm 13 and also the abutment edge 16 having been swung into a position in which a self-locking effect is achieved which prevents the connection member being pressed out of the bores of the reinforcement strips.
Figure 2:
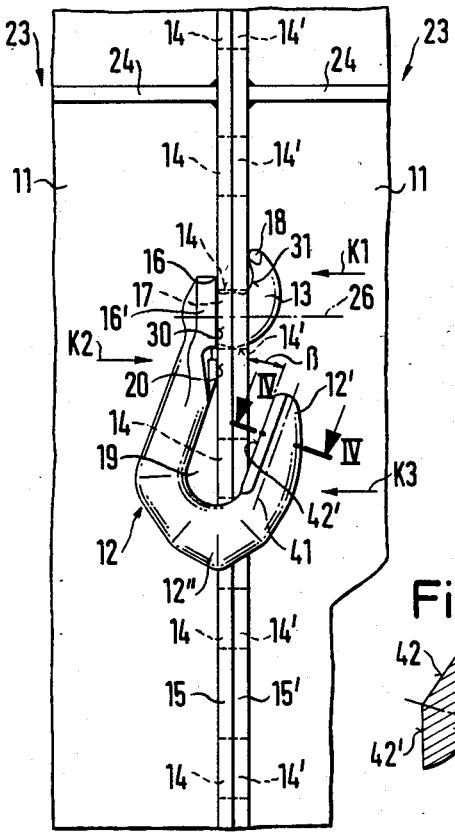
Figure 3:
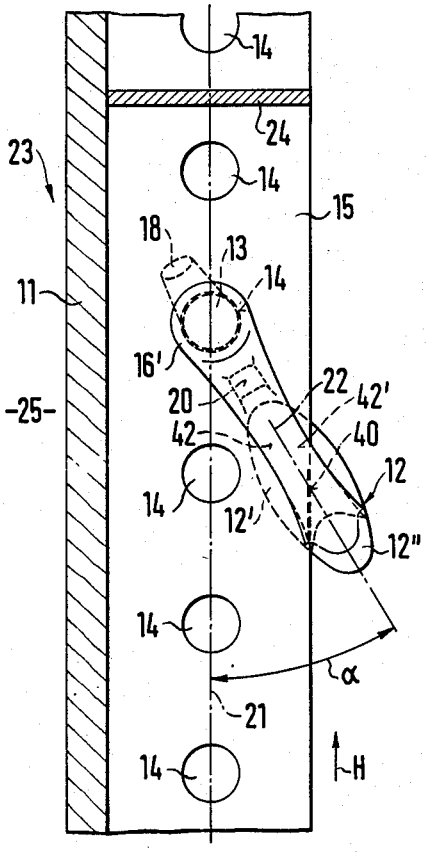

As seen in FIGS. 1 to 3 each shuttering panel 23 comprises a preferably flat shuttering skin or board 11 of preferably rectangular or square shape. At its edges the shuttering skin 11 is rigidly connected with reinforcement strips 15, 15' in non-illustrated manner, with the reinforcement strips for example consisting of steel. The reinforcement strips 15 thus extend perpendicular to the shuttering skins 11 and have a constant depth and thickness over their entire length. At specific intervals stiff reinforcement bands 24, which preferably have the same depth as the reinforcement strips 15, 15', branch off from the reinforcement strips and extend perpendicular to these reinforcement strips 15, 15' and to the shuttering skins 11. These reinforcement strips serve in the same way as the reinforcement strips 15, 15' to reinforce the shuttering skins 11. The liquid concrete is later introduced, after the installation of the shuttering apparatus, into the space 25 in front of the shuttering skins 11.

A plurality of equality sized, circular throughgoing connection bores 14, 14' is provided in the reinforcement strips 15, 15' with these connection bores being distributed over the entire length of the reinforcement strips 15, 15'. The bores 14 are preferably located at approximately the half depth of the reinforcement strips 15, 15', i.e. approximately on the central longitudinal axis 21 (FIG. 3) of the reinforcement strips 15.

Should two shuttering bores 23 be arranged alongside or above one another in order to realize a shuttering apparatus with a certain areal extent then these two shuttering panels 23 must be arranged in accordance with FIGS. 1 and 2 with their edges such that the flat reinforcement strips 15, 15' which are located there come into contact with another, and indeed in such a way that the surfaces of the adjacent shuttering skins 11 which face the space 25 are aligned with one another and the anchorage bores 14, 14' of the two contacting reinforcement strips 15 are also aligned with one another.

The connecting element in accordance with the invention for two shuttering panels 23 comprises a hook-like curved hook part 12 with a free engagement end 12' and a flange 16' forming an abutment edge 16 at the opposite end, a spigot part 17 which projects substantially perpendicularly from the abutment flange 16' and a lever arm 13 with a concavely curved inner surface 31 which adjoins the spigot part 17 and is curved or kinked in the same sense as the hook part 12.

The spigot part 17 has a diameter which is only fractionally smaller than the bores 14, 14' and is of slightly spherical shape at its periphery in the manner shown in FIGS. 1 and 2, with the center point of the sphere lying on its central axis 26 at the half axial length of the spigot part 17. The length of the spigot part 17 corresponds to the total length of two bores 14 which directly follow one another in accordance with FIGS. 1 and 2. In other words the length of the spigot part 17 is approximately twice as large as the thickness of one of the uniformly thick reinforcement strips 15 or 15'.

The lever arm 13 starts in the region of the end of the spigot part 17 remote from the flange 16' with the same diameter as the spigot part 17 at this position, and then tapers continuously up to its end surface 18. At the same time the lever arm 13 is arcuately curved so that it has approximately the shape of a scythe as seen in the sideview of FIGS. 1 and 2. The cross-section of the spigot part 17 is initially circular and then changes progressively into an ellipse shape towards the end surface 18 (FIG. 3). The flange 16' which carries the abutment edge 16 has a flat surface 30 facing the spigot part 17 from which the spigot part 17 emerges at right angles. At the surface of the hook part 12 facing the engagement end 12' there is located a flat support surface 20 at a distance from the flange 16, with the flat support surface projecting somewhat further forwardly in the direction of the spigot part 17 than the flat surface 30 of the flange 16'.

In accordance with the invention the hook part 12 extends - starting from the flange 16' - first of all substantially perpendicular to the axis 26 of the spigot part 17 up to the level of the support surface 20 and then bends downwardly somewhat in a direction away from the lever arm 13. In this manner a clear spacing which first increases and then decreases again is present in the installed state in accordance with FIG. 2 between the regions of the hook part 12 which are somewhat removed from the flange 16 and the reinforcement strip 15.

The central axis 27 of the hook part 12, the central axis 26 of the spigot part 17 and the central axis 28 of the lever arm 13 lie, in accordance with FIG. 1, preferably in one plane in which the longitudinal axis 22 of the connecting element 12, 13, 16, 17 of the invention also relies in accordance with the view of FIG. 3.

The installation of a shuttering apparatus with the connection member in accordance with the invention proceeds as follows:

First of all the two shuttering panels 23 which are to be connected are placed alongside one another in accordance with FIGS. 1 and 2 until two holding bores 14 are aligned with each other. The connecting element with the lever arm 13 to the fore is then introduced in the manner shown in FIG. 1 from the side into the aligned bores 14, 14'. In so doing the plane 26, 27, 28 which coincides with the longitudinal axis 22 extends substantially perpendicular to the planes of the reinforcement strips 15. It is important that the bores 14, 14' have a distance from the rear surfaces of the shuttering skins 11 such that sufficient space is available for the hook part 12 and the flange 16, in order to permit insertion of the tapering curved lever arm 13 into the bores 14, 14' in the manner which can be seen from FIG. 1. The connecting element is then pivoted in accordance with the arrow F in FIG. 1 about an axis standing substantially perpendicular to the plane of the drawing of FIG. 1, whereupon the spigot part 17 penetrates in accordance with FIG. 5 into the mutually aligned bores 14 14' and the sickle-like lever arm 13 slides around the upper edge 29 of the bore 14, i.e. the right upper edge in FIG. 1, until the spigot part 17 has largely entered into the bores 14, 14' and the elliptical end surface 18 of the sickle-like curved lever arm 13 comes into contact with the right hand reinforcement strip 15' of FIG. 1. At the same time the upper end of the flange 16' in FIG. 1, i.e. the abutment edge 16 contacts the other reinforcement strip 15. On further pivoting of the connection member the two reinforcing strips 15, 15' are drawn together, because they are trapped between the abutment edge 16 and first of all the concave inner surface 31 and then the end surface 18, with a large lever arm ratio until finally the support surface 20 contacts the associated reinforcement strip 15 in the manner shown in FIG. 2. At the same instant the inner surface of the engagement end 12' of the hook part 12 comes approximately into alignment with the same reinforcement strip 15' with which the end surface 18 is in contact. The connection member 12, 13, 17 is now pivoted downwardly about the axis 26 in FIG. 2 so that the engagement end 12' of the hook part 12 engages behind the right hand reinforcement strip 15' in FIG. 2 and comes into clamping engagement with the latter. This pivotal process can be assisted by blows by means of a hammer on the hook part 12. The pivoting proceeds until the lower web 12'' of the hook part 12 has come into contact with the rear edge of the reinforcement strips 15, 15'. This end state is shown in FIGS. 2 and 3.

The connecting element is now in clamping connection with the surfaces of the reinforcement strips 15, 15' at the surface 18, at the support surface 20 and finally also at the position 40 of the engagement end 12' indicated in FIG. 3. The clamping forces K1, K2 and K3 are illustrated schematically in FIG. 2. They act in turn on the reinforcement strips 15, 15' from opposite sides.

As a result of the frictional forces produced by these clamping forces the connection member of the invention is now immovably retained in the final installed position shown in FIGS. 2 and 3.

Corresponding connection members can now be arranged at desired intervals in further pairs of holding bores 14, 14' in order to obtain a connection which is stiff in bending of all the shuttering panels 23 which are to be connected with one another.

To release the connection it is only necessary to exert a force in connection with the arrow H in FIG. 3 on the part of the connection member which projects rearwardly over the reinforcement strips 15 in order to release the clamped connection and to pivot the connection member upwardly out of its engaged position. The connection member can subsequently be effortlessly pivoted back into the position shown in FIG. 1 and removed from the shuttering panels in the reverse sense for further use.

As a result of the construction of the invention the connection member can thus also be very easily removed again from the shuttering panels since it is at most necessary to exert light hammer blows merely in the centrally longitudinal direction of the reinforcement strips 15 and not perpendicular to their surfaces. In the latter case resilient yielding could occur during blows which would make release more difficult.

Figure 5:
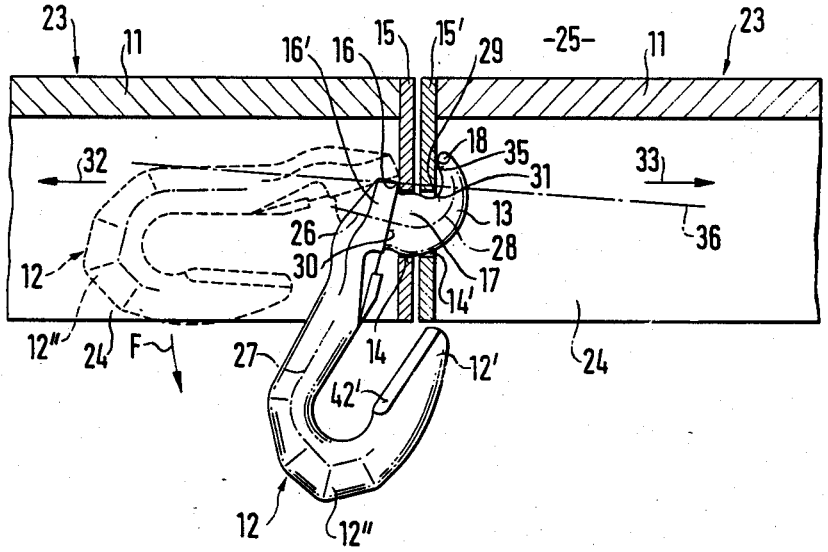

In FIG. 5 the hook part 12 is shown in its intermediate position between the initial position shown in broken lines and the final position of FIGS. 2 and 3. On further pivoting of the hook part 12 beyond the position shown in FIG. 5 the end surface 18 and the abutment edge 16 press the two reinforcement strips 15, 15' against one another, so that the gap which is initially present between them disappears. The pressing together of the reinforcement strips 15, 15' can also take place in that, with a somewhat different dimensioning and shaping the concave inner surface 31 of the lever arm 13 slides along the upper edge 29 of the right hand bore 14' in FIG. 5 while the end surface 18 only comes into engagement with the right hand reinforcement strip 15 at a later stage of the pivoting process. This embodiment is preferred since in this way even larger forces can be exerted which pull the reinforcement strips 15, 15' together.

The special feature of the embodiment of FIG. 5 lies in the fact that on being upwardly pivoted out of the installed position (FIGS. 2, 3), and by subsequently minor pivoting into the position of FIG. 5, the contact point of the abutment edge 16 at the reinforcement strip 15 is so displaced relative to the point of contact 35 of the end surface 18 on the reinforcement strip 15' in the direction perpendicular to the plane of the shuttering skins 11 that these points of contact lie on a chain-dotted line 36 in FIG. 5. If the two connecting strips 15, 15' are now acted on by forces 32, 33 which are perpendicular to the reinforcing strips 15, 15' and try to pull them apart then a moment is generated via the point of contact of the abutment edge 16 on the reinforcement strip 15 and the point of contact 35 on the reinforcement strip 15' which tends to pivot the hook part 12 in the direction of the arrow F. Thus in the position of FIG. 5 there is a self-locking of the connecting element in the sense that it cannot fall on its own accord out of the illustrated position when forces are acting between the shuttering panels 23 in the sense of the arrows 32, 33.

Thus, even when the connecting element has not been secured by being downwardly pivoted into the position of FIGS. 2 and 3 there is no danger of an undesired pressing of the spigot part 17 out of the bores 14, 14'.

It is of particular significance that the surface 42 of the engagement end 12' of the hook part which comes into engagement with the reinforcement strips 15, 15' of FIG. 2 includes in the installed state of FIG. 2 a relatively small angle $\beta$ with the longitudinal direction of the reinforcement strips 15, 15' as seen from the rear side. In this manner a certain wedging effect is obtained on pivoting the hook part 12 downwardly which ensures fixed clamping of the hook part 12 on the drawn together reinforcement strips 15, 15' even when there are fluctuations in thickness of the reinforcement strips 15, 15' or fluctuations in spacing.

Figure 4:
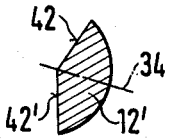

FIG. 4 shows a section perpendicular to the longitudinal axis 41 of the engagement end 12 as taken on the line IV–IV in FIG. 2. As seen in FIG. 4 the surface 42 of the engagement end 12' which comes into engagement with the reinforcement strip 15 is likewise of oblique shape in order to obtain, in conjunction with the oblique arrangement of this surface in FIG. 2, a linear or strip-like contact surface between the rear edge of the reinforcement strip 15' and the engagement end 12'.

As seen in FIG. 4 two obliquely extending surfaces 42, 42' are provided symmetrically to the central longitudinal plane 34 of the engagement end 12', of which the one surface (42) comes into engagement with the reinforcement strip 15' in the position shown in FIG. 2 and the other comes into engagement therewith when the connecting element is arranged in a position which is displaced through 180° relative to FIG. 2. For this reason there are a number of possibilities of variation with respect to the arrangement of the connecting element. After being inserted in accordance with FIGS. 1 and 5 it can be pivoted upwardly or downwardly depending on the spatial conditions. It can moreover also be inserted from the left or the right into the aligned bores 14, 14'.

The construction in accordance with the invention of the hook part 12, of the spigot part 17 and of the lever arm 13 has furthermore the advantage that self-locking also occurs when the hook part 12 is not yet in engagement with the reinforcement strip 16 (FIG. 5). This is in particular to be attributed to the construction in accordance with the invention of the abutment edge 16 and also of the end surface 18. The advantage is greater reliability against an intentional release of the connecting element.

Tolerances in thickness can be compensated for without problem as result of the wedge-like surfaces 42, 42'; in particular uniformly increasing stress arises between the connecting element and the reinforcement strips 15, 15' on the pivoting the hook part 12 downwardly.

What is claimed is:

1. Shuttering apparatus having at least two shuttering panels which respectively comprise a shuttering skin and reinforcement strips which are disposed at at least some of the edges of the shuttering panels, which project substantially perpendicular to their rear sides and which have a plurality of connection bores; and at least one connection member for two adjacent shuttering panels, with the connection member having a spigot part which can be passed through two mutually aligned bores of two directly contacting reinforcement strips and a hook part which branches off from one end of the spigot part, and which can be brought, when the spigot part is inserted, by pivoting of the hook part into engagement with a said reinforcement strip which faces away from a connection plane between the spigot and the hook part, wherein the spigot part (17) only has a length substantially the same as a thickness of the two reinforcement strips (15, 15') through which it passes, is restrictedly pivotable about an axis perpendicular to a plane formed by its central longitudinal axis (26) and that (27) of the hook part (12), and also passes at an end remote from the connection plane (30) with the hook part (12) into a crooked lever arm (13) which is remote from the hook part (12) and of smaller cross-section than the bores (14, 14'), with the lever arm being insertable through the two substantially aligned bores (14, 14') from one side of one of the reinforcement strips (15) until the spigot part (17) is located inside the bores (14, 14') and an outer end surface (18) of the lever arm (13) remote from the hook part (12) contacts the other reinforcement strip (15'); wherein the hook part (12) has a support surface (20) at a side of the spigot remote from the lever arm (13) and facing opposite to the reinforcement strip (15) provided at the connection plane (30) with the support surface (20) coming into contact in the installed state with the reinforcement strip (15) disposed at the connection plane (30) when the spigot part (17) is inserted into the bores (14, 14'); and wherein when an engagement end (12') of the hook part (12) is in engagement with the associated reinforcement strip (15') the support surface (20) is clamped against the contacting reinforcement strip (15) on a side opposite to the engagement end (12'), and the end surface (15') of the lever arm (13) is clamped against the contacting reinforcement strips (15) from a same side as the engagement end (12').

2. Shuttering apparatus in accordance with claim 1, wherein the connection member has a rounded abutment edge (16) at the side of the spigot part (17) remote from the hook part (12) and substantially in alignment with the connection plane (30) between the hook part (12) and the spigot part (17), with the abutment edge contacting the reinforcement strip (15) facing the insertion side during introduction of the spigot part (17) into the aligned bores (14, 14'); wherein the lever arm (13) has a cross-section which reduces in a direction away from the spigot part (17) and can be passed through the two substantially mutually aligned bores (14, 14') of the at least closely adjacent reinforcement strips (15, 15') until the abutment edge (16) contacts the reinforcement strip remote from the lever arm (13) whereupon, by action of force on the hook part (12) which has not yet engaged with the reinforcement strip (15') such that a torque is generated about the contact point of the abutment edge (30) on the reinforcement strip (15), a correspondingly constructed concave inner surface (31) of the lever arm (13) is guided along an edge (29) facing the shuttering skin (11) of the bore (14) remote from the introduction side or, if the reinforcement strips (15) have not yet fully contacted one another, is pressed against the edge (29) and is pushed slidingly over the edge (29) to draw together the reinforcement strips (15, 15') which are not yet fully in contact, until the spigot part (17) is located inside the bores (14, 14') and the outer end surface of the lever arm (13) remote from the hook part (12) comes into contact with the reinforcement strip (15') remote from the connection plane (30) and also until the support surface (20) comes into contact with the associated connection strip (15), whereupon the engagement end (12') of the hook part (12) is pivoted into engagement with the associated connection strip (15').

3. Shuttering apparatus in accordance with claim 2, wherein the concave inner surface (31) of the lever arm (13) is so curved in a direction perpendicular to the central axes (26, 27, 28) that it has a contact portion with the edge (29) of the hole which is as large as possible on contact with the edge (29) of the hole.

4. Shuttering apparatus in accordance with claim 2, wherein the concave inner surface (31) of the lever arm (13) is so curved that it can also enter into engagement with the edge (29) of the hole on introducing the lever arm into the aligned bores (14, 14') even when the reinforcement strips (15, 15') to not fully contact one another; and wherein on pivoting the spigot part (17) into the aligned bores (14, 14') the concave inner surface (31) exerts, with the abutment edge (16) being braced against the other reinforcement strip (15), an increasing clamping force on the associated reinforcement strip (15') such that the two reinforcement strips (15, 15') are drawn firmly against one another.

5. Shuttering apparatus in accordance with claim 2, wherein the abutment edge (16) and the end surface (18)

of the lever arm (13) are so displaced relative to one another in the plane of the central axes (26, 27, 28) that a moment which biases the connection member (12) into its engaged position is achieved by the forces (32, 33) which are trying to separate the two reinforcement strips (15, 15') which are to be connected, said moment being achieved when the connection member (27) is already located in an engagement position which holds the connection strips (15, 15') together and which is no longer far removed from its position in the finally installed state.

6. Shuttering apparatus in accordance with claim 1, wherein the hook part (12) has a substantial spacing (19) from the next closest reinforcement strip (15) in the installed state, other than in the region of the support surface, at the side of the reinforcement strips (15, 15') remote from its engagement end (12').

7. Shuttering apparatus in accordance with claim 1, wherein the lever arm (13) has essentially the shape of an arc which extends over an angle of approximately 180°.

8. Shuttering apparatus in accordance with claim 1, wherein the lever arm (13) tapers continuously starting from the spigot part (17).

9. Shuttering apparatus in accordance with claim 1, wherein the lever arm (13) merges from a substantially round cross-section at the spigot part (17) to an elliptical cross-section in a region of the outer end surface (18), with the longer axis of the ellipse extending perpendicular to the plane of the central axes (26, 27, 28), and with the end surface (18) being expediently flattened to form a larger contact surface.

10. Shuttering apparatus in accordance with claim 1, wherein the connection member includes an abutment edge (16) that is an element of a flange (16) which extends around the spigot part (17).

11. Shuttering apparatus in accordance with claim 1, wherein the additional support surface (20) lies substantially at a half distance between the end surface (18) of the lever arm (13) and the engagement end (12') of the hook part (12).

12. Shuttering apparatus in accordance with claim 1, wherein a lever counterarm formed by the hook part (12) is about 5 to 15 times as long as the distance between the end surface (18) of the lever arm (13) and the abutment edge (16).

13. Shuttering apparatus in accordance with claim 1, wherein the spigot part (17) has the surface shape of a portion of a ball with a diameter approximately the same as the diameter of the connecting bores (14, 14').

14. Shuttering apparatus in accordance with claim 1, wherein in the installed state the angle ($\alpha$) between the longitudinal axis (21) of the reinforcement strips (15, 15') and the plane (22) of the central axis (26, 27, 28) of the connection element amounts to about 15° to 45°

15. Shuttering apparatus in accordance with claim 2, wherein the support surface (20) projects, in the installed state, somewhat further in a direction of the reinforcement strips (15, 15') than the abutment edge (16).

16. Shuttering apparatus in accordance with claim 2, wherein the engagement end (12') of the hook part (12) includes, in the installed state, when viewed towards the a side of the reinforcement strips (15), a small angle ($\alpha$) of about 3° to 10° relative to a longitudinal direction of reinforcement strips (15, 15').

17. Shuttering apparatus in accordance with claim 1, wherein the engagement end (12') has substantially greater width in a section substantially perpendicular to its longitudinal axis (41) than oppositely disposed regions of the hook part (12), and wherein a surface (42) which in the installed state faces the associated reinforcement strip (15') is obliquely shaped such that the engagement end (12') contacts the associated reinforcement strip (15') in the installed state linearly.

18. Shuttering apparatus in accordance with claim 17, wherein a surface (42) of the engagement end (12') which enters into engagement with the reinforcement strip (15') is of substantially flat shape and represents a section through a trapezoidal thread-like screw surface, whose central axis, coincides with a central axis (26) of the spigot part (17).

19. Shuttering apparatus in accordance with claim 17, wherein the engagement end (12') has included surfaces (42, 42') which are constructed in mirror-like manner relative to one another on both sides of its central longitudinal plane (34) such that a strip-like clamping can be effected between the engagement end (12') and the reinforcement strip (15, 15') irrespective of the side from which the lever arm (13) is introduced into the aligned bores (14, 14').

* * * * *